US006189500B1

(12) United States Patent
Gyllenstedt

(10) Patent No.: US 6,189,500 B1
(45) Date of Patent: Feb. 20, 2001

(54) INTERNAL COMBUSTION ENGINE PISTON

(75) Inventor: Jan Gyllenstedt, Kungälv (SE)

(73) Assignee: AB Volvo, Gothenburg (SE)

( * ) Notice: Under 35 U.S.C. 154(b), the term of this patent shall be extended for 0 days.

(21) Appl. No.: 09/341,725

(22) PCT Filed: Jan. 15, 1998

(86) PCT No.: PCT/SE98/00056

§ 371 Date: Aug. 11, 1999

§ 102(e) Date: Aug. 11, 1999

(87) PCT Pub. No.: WO98/31929

PCT Pub. Date: Jul. 23, 1998

(30) Foreign Application Priority Data

Jan. 16, 1997 (SE) ..... 9700109

(51) Int. Cl.[7] ..... F02F 3/02
(52) U.S. Cl. ..... 123/193.6
(58) Field of Search ..... 123/193.6

(56) References Cited

U.S. PATENT DOCUMENTS

| | | | | |
|---|---|---|---|---|
| 1,462,501 | * | 7/1923 | Barwald | 123/193.6 |
| 2,311,039 | * | 2/1943 | Emery | 123/193.6 |
| 4,111,104 | * | 9/1978 | Davison | 123/193.6 |
| 4,256,022 | * | 3/1981 | Elsbett et al. | 123/193.6 |
| 4,716,817 | | 1/1988 | Ripberger et al. . | |
| 4,829,955 | | 5/1989 | Strasser . | |
| 5,072,653 | * | 12/1991 | Parsons | 123/193.6 |
| 5,211,101 | | 5/1993 | Letsch et al. . | |
| 5,245,913 | * | 9/1993 | Kato | 123/193.6 |

FOREIGN PATENT DOCUMENTS 755235 8/1951 (DE) .

* cited by examiner

*Primary Examiner*—Marguerite McMahon
(74) *Attorney, Agent, or Firm*—Young & Thompson

(57) ABSTRACT

Piston for an internal combustion engine has a top ring land with a diameter differential of at least 0.3% of the major diameter to eliminate the risk of cylinder polishing.

7 Claims, 1 Drawing Sheet

INTERNAL COMBUSTION ENGINE PISTON

BACKGROUND OF THE INVENTION

The present invention relates to a piston for an internal combustion engine comprising an essentially cylindrical body with a plurality of axially spaced ring grooves in its lateral surface spaced from an end surface, a first portion of the cylindrical body, lying between the end surface and the most closely adjacent ring groove, having varying cross section.

DESCRIPTION OF THE RELATED ART

It is a known fact that pistons for internal combustion engines change their shape during engine operation under the influence of heat in the combustion chamber and the occurrence of dynamic forces.

The shape of the piston in its cold state must therefore be adapted to these changes in shape so that there is maintained between the piston and the cylinder wall, a clearance which is neither so small as to risk polishing of the cylinders when coke is deposited on the piston, nor so large that emissions and performance are negatively affected. Cylinder polishing results in increased oil consumption and can result in shearing.

The shape of the piston must also be adapted to those changes in shape which occur in the engine block itself as it is heated, which results in the outer cylinders in a multicylinder engine becoming inclined relative to the center cylinders. In other words, the cylinders will assume a "fan" shape as the engine block is heated and expands more at the top than at the bottom during engine operation.

In order to adapt the shape of the piston to this changing shape in the engine block, it is common to make the piston with an oval cross section with the minor diameter oriented in the longitudinal direction of the engine. The difference between the major and minor diameters of this piston portion is, in previously known engine designs, not larger than about 0.15 mm, which means a "normal" so-called top ring land clearance in the transverse direction of the engine of 0.40 mm and in the longitudinal direction of 0.55 mm when the engine is cold. In a known engine with a 131 mm cylinder diameter, this means a difference between the major and minor diameters which is about 0.1% of the major diameter. This clearance has, however, in certain engine designs not proved to be sufficient to eliminate the risk of polishing of the cylinders. It is a known fact that a small top ring land clearance can increase the risk of polishing the cylinder. This can be avoided by providing the piston with a large top ring land clearance. The clearance in this case has amounted to about 2 mm, which has, however, led to a large detrimental volume having a negative effect on emissions and performance.

SUMMARY OF THE INVENTION

The purpose of the present invention is to achieve a piston of the type described by way of introduction, by which it is possible to avoid cylinder polishing without making the detrimental volume so large that emissions and performance are affected more than marginally.

This is achieved according to the invention by virtue of the invention that the difference between the major and minor diameters of the cross section of the top ring land of the piston is at least 0.3% of the major diameter.

The invention is based on the idea of first investigating where cylinder polishing occurs and having a top ring land ovality which provides as little clearance as possible where no polishing occurs and increases the clearance only so much in the polished cylinder portions that polishing is avoided. Tests performed have shown that for a given engine design, polishing could not be avoided with common top ring land ovality on the order of 0.15 mm, i.e. about 0.1%, while it was only possible to eliminate polishing from 0.3%.

BRIEF DESCRIPTION OF THE DRAWING

The invention will be described in more detail below with reference to examples shown in the accompanying drawing, where

In FIG. 1, 1 designates a cylinder lining in a multicylinder internal combustion engine of diesel type and 2 designates the upper portion of a piston, the lower portion (not shown) of which can be made in one piece with the upper portion 2 or be a separate portion joined with the latter, i.e. a pendulum piston. The upper portion 2 of the piston is made with first, second and third ring grooves 3, 4 and 5, respectively, for piston rings (not shown).

Figure 1:
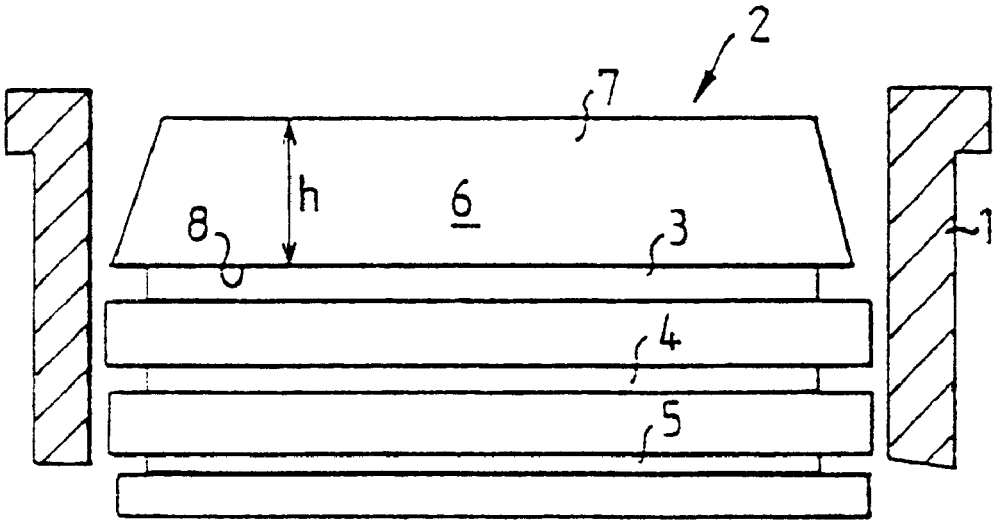
FIG. 1 shows a schematic longitudinal section through a cylinder lining with a portion of a piston therein in accordance with the invention.
Figure 2:
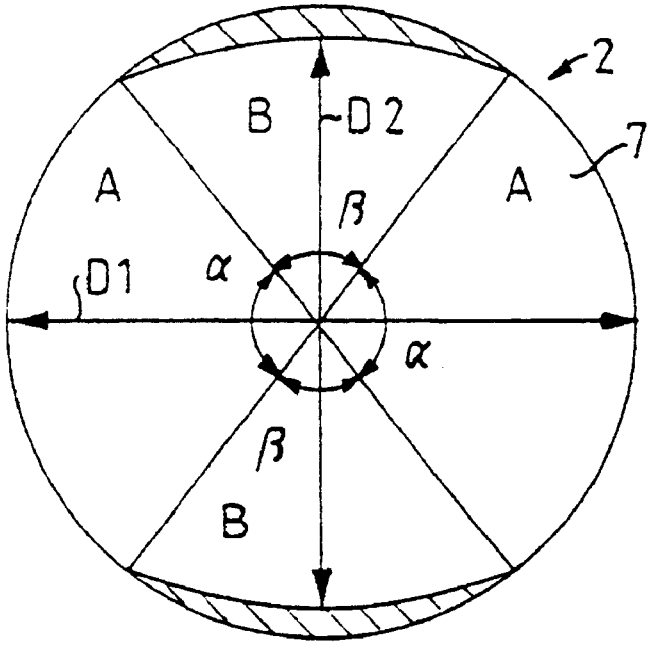
FIG. 2 shows the piston in FIG. 1 seen from above and with its ovality greatly exaggerated.

The so-called top ring land of the piston, i.e. the piston portion 6 between the upper surface 7 and the upper piston edge 8 of the first piston ring groove 3 is, firstly, slightly conical, as shown greatly exaggerated in FIG. 1, and is, secondly, oval as is shown greatly exaggerated in FIG. 2. D1 marks the diameter of the basic circle, i.e. the largest diameter of the oval piston portion 6, while D2 marks the smallest diameter of this portion 6.

Tests performed have shown that the difference between D1 and D2 must be at least 0.3% of D1 over a certain portion of the height h of the top ring land 6 of the piston and that the greatest difference should not exceed 3%. In tests performed on an engine with an inner diameter of 131 mm of the cylinder lining and a piston with an ovality of the piston top ring land which was 0.99 mm, the greatest clearance between the piston and the cylinder lining for a cold engine was 9.5 mm in the longitudinal direction of the engine and 0.51 mm in the transverse direction of the engine. It was found that previous problems with the same engine as regards cylinder polishing when the top ring land ovality was 0.15 mm could be completely eliminated without affecting performance and emissions more than marginally, when the ovality was increased to 0.99 mm, was having a diameter difference of about 0.8% instead of about 0.1%.

In FIG. 2, the shaded areas mark the deviation of the top ring land oval from a perfect circle. The sections A within the angular sectors $\alpha$ have a small top ring land clearance with a major diameter D1, while the sectors B within the angular sectors $\beta$ have a varying diameter with a minimum diameter D2 at the center of the sector, so that a soft transition is obtained between the sectors B with large clearance and the sectors A with small clearance to the cylinder lining. The sector angle $\alpha$ can vary from a minimum of 15° to a maximum of 120° depending on the engine. The positions of the sectors are determined by those locations in which testing has shown that there is a risk of polishing. It is most common, however, that polishing occurs in the longitudinal direction of the engine and that D2 is thus parallel to the longitudinal direction.

What is claimed is:

1. Piston for an internal combustion engine comprising:

an essentially cylindrical body (2) with a plurality of axially spaced ring grooves (3,4,5) in its lateral surface spaced from an end surface (7), a first portion of the cylindrical body (6), lying between said end surface (7) and the most closely adjacent ring groove (3), having a varying cross section at any plane parallel with the end surface, the cross section being an oval shape and having a maximum diameter (D1) and a minimum diameter (D2), wherein the difference between the maximum and minimum diameters (D1,D2) of the cross section is at least 0.3% of the maximum diameter (D1).

2. Piston according to claim 1, wherein the difference between the maximum and minimum diameters (D1,D2) of the cross section is at most 3% of the maximum diameter (D1).

3. Piston according to claim 1, wherein the maximum and minimum diameters (D1,D2) increase from the end surface (7) to the most closely adjacent ring groove (3).

4. Piston according to claim 1, wherein the piston is housed in a cylinder (1) with constant diameter and that the difference between the diameter of the cylinder and the minimum diameter (D2) of said cross section of said piston portion (2) is less than 3% of the cylinder diameter, while the difference between the cylinder diameter and the maximum diameter (D1) of said piston portion (2) is greater than 0.3% of the cylinder diameter.

5. Piston according to claim 2, wherein the maximum and minimum diameters (D1,D2) increase from the end surface (7) to the most closely adjacent ring groove (3).

6. Piston according to claim 2, wherein the piston is housed in a cylinder (1) with constant diameter and that the difference between the diameter of the cylinder and the minimum diameter (D2) of said cross section of said piston portion (2) is less than 3% of the cylinder diameter, while the difference between the cylinder diameter and the maximum diameter (D1) of said piston portion (2) is greater than 0.3% of the cylinder diameter.

7. Piston according to claim 3, wherein the piston is housed in a cylinder (1) with constant diameter and that the difference between the diameter of the cylinder and the minimum diameter (D2) of said cross section of said piston portion (2) is less than 3% of the cylinder diameter, while the difference between the cylinder diameter and the maximum diameter (D1) of said piston portion (2) is greater than 0.3% of the cylinder diameter.

* * * * *